US007297069B2

(12) United States Patent
Donovan et al.

(10) Patent No.: US 7,297,069 B2
(45) Date of Patent: Nov. 20, 2007

(54) PUTTING PRACTICE AID

(75) Inventors: Michael Kevin Donovan, Trentham Park (GB); Michael John Boyle, Stoke-on-Trent (GB)

(73) Assignee: The Puttalite Company Limited, Staffordshire (GB)

( * ) Notice: Subject to any disclaimer, the term of this patent is extended or adjusted under 35 U.S.C. 154(b) by 218 days.

(21) Appl. No.: 11/220,829

(22) Filed: Sep. 7, 2005

(65) Prior Publication Data

US 2006/0252567 A1 Nov. 9, 2006

(30) Foreign Application Priority Data

May 4, 2005 (GB) ..... 0509050.1

(51) Int. Cl.
*A63B 69/36* (2006.01)

(52) U.S. Cl. ..... 473/173; 473/221

(58) Field of Classification Search ..... 473/173, 473/174, 180, 192, 198, 199, 220, 221
See application file for complete search history.

(56) References Cited

U.S. PATENT DOCUMENTS

| | | | | |
|---|---|---|---|---|
| 2,263,727 | A * | 11/1941 | Gensburg | 273/118 A |
| 4,160,942 | A * | 7/1979 | Lynch et al. | 359/443 |
| 4,560,167 | A | 12/1985 | Perreau et al. | |
| 5,092,602 | A * | 3/1992 | Witler et al. | 473/199 |
| 5,221,082 | A * | 6/1993 | Curshod | 473/199 |
| 2006/0252567 | A1 * | 11/2006 | Donovan et al. | 473/173 |

FOREIGN PATENT DOCUMENTS

| | | |
|---|---|---|
| WO | WO 97/04839 | 2/1997 |

* cited by examiner

*Primary Examiner*—Raleigh W. Chiu
(74) *Attorney, Agent, or Firm*—Laurence P. Colton; Smith, Gambrell & Russell, LLP

(57) ABSTRACT

A putting practice aid includes a light source to provide a virtual golf hole putting target and a detector to detect a golf ball with respect to the virtual golf hole.

22 Claims, 3 Drawing Sheets

Fig_3
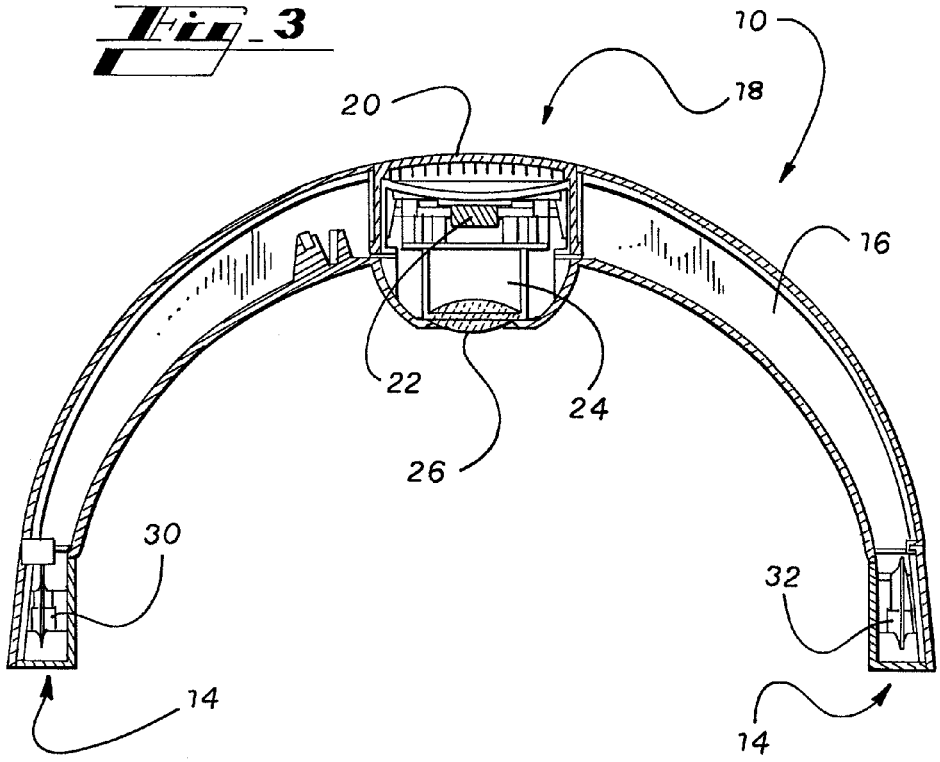
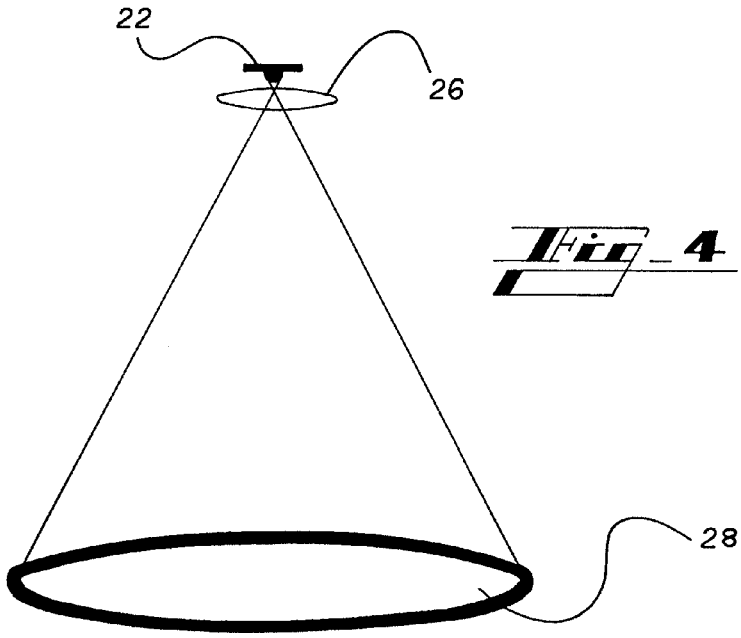
Fig_4

PUTTING PRACTICE AID

BACKGROUND OF THE INVENTION

This invention relates to a putting practice aid.

A number of putting practice aids have been proposed for golfers over the years. Such aids have generally not been particularly realistic in mimicking a true golf hole. Furthermore, in many instances they have not provided an indication as to whether a golf shot has been hit at a required strength to enter a hole, i.e. if a ball is hit too strongly it will pass over the hole, or run around the edge and not enter the hole.

An important feature with putting is that a golfer should not move their head whilst playing the shot nor immediately after playing it, and should look downwardly at the ball whilst playing the shot. With many putting aids there is a temptation for a player to raise their head whilst, or at least immediately after playing a shot, to see whether the shot is successful. This feature makes it difficult to improve one's putting significantly using such aids, and it is also difficult to obtain much feedback concerning shots played.

SUMMARY OF THE INVENTION

According to the present invention there is provided a putting practice aid, the aid including an arrangement for producing an image of a golf hole on the ground, and a detecting arrangement for determining the speed and direction of a golf ball directed at the visual image to ascertain whether the golf ball would have fallen into a golf hole at the image.

The detecting arrangement includes means for detecting where a ball crosses the image, and whether this would cause the ball to fall in a hole at the image. The aid may include a frame extendible spaced above the ground. The image producing arrangement may be provided on the frame and may include a light shinable downwardly to produce an image of a golf hole of a required size and shape. The image producing arrangement may include an LED which shines onto a lens.

The detecting arrangement may include the means for producing a plurality of beams which extend across the golf hole image, and means for determining when and for how long the beams are broken by a golf ball.

The beams may be infra red or visible light.

The detecting arrangement may produce a pair of detection beams which are inclined relative to each other and which pass through the golf hole image and permit the speed, position and direction of a golf ball passing through the image to be determined.

The detecting arrangement may produce an outer beam or beams to determine the general direction in which a golf ball is travelling.

The detecting arrangement may produce a beam to determine whether a golf ball remains on or adjacent the golf hole image after a shot has been played.

The detecting arrangement is configured such that the beams extend above the ground at a height substantially equal to the centre of a golf ball.

The frame may include two ground engaging parts each locatable on an opposite side of the golf hole image. The detecting arrangement may include beam transmitters provided on a one of the ground engaging parts, with respective beam receivers provided on the other of the ground engaging parts.

The aid is arranged such that after a golf shot has been played at the golf hole image, and the speed, location and direction of the golf ball has been determined by the detecting arrangement, a signal is provided to indicate whether the golf ball would have fallen into the hole.

The signal may also indicate where the ball crossed the hole and whether this would have caused the ball to fall in the hole.

The signal is audible, and is desirably a spoken message.

BRIEF DESCRIPTION OF THE DRAWINGS

FIG. 3 is a cross sectional side view along the line X-X of FIG. 2;

FIG. 4 is a schematic view illustrating part of the operation of the aid of FIG. 1.

DETAILED DESCRIPTION OF THE INVENTION

Figure 2:
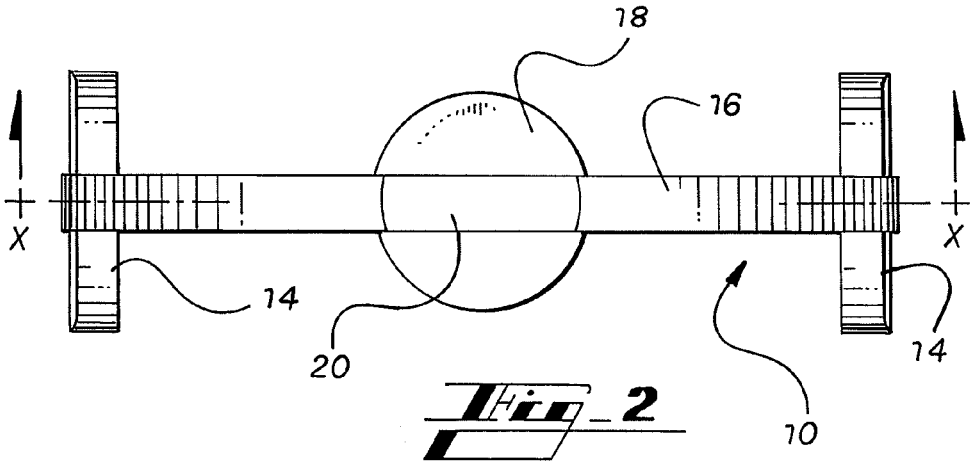
FIG. 2 is a plan view of the aid of FIG. 1.
Figure 1:
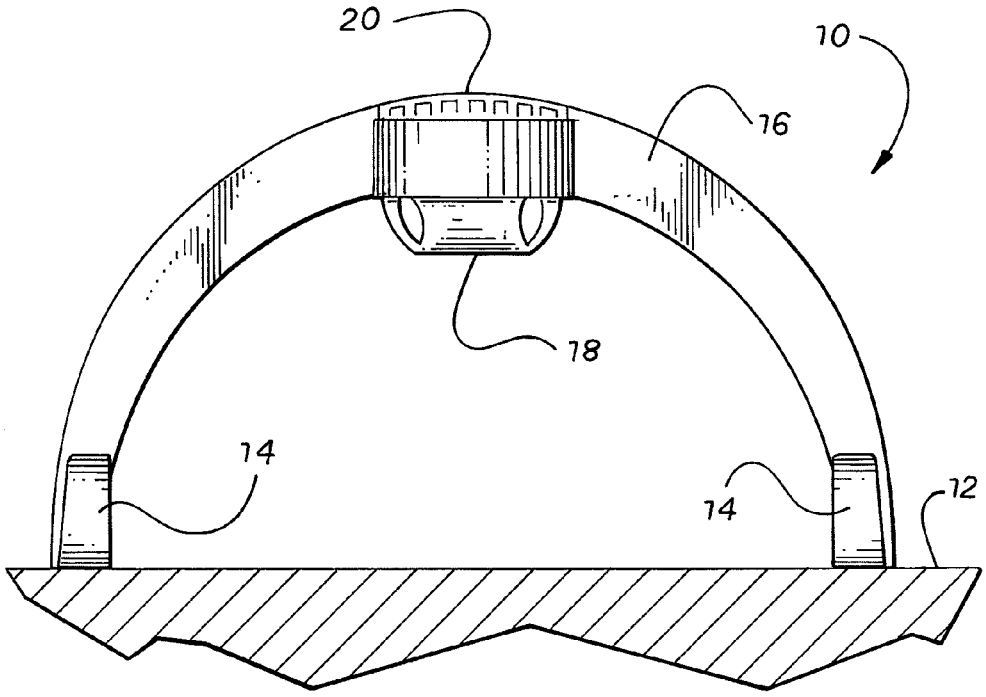
FIG. 1 is a diagrammatic side view of a putting practice aid according to the invention.

FIGS. 1-3 show a putting practice aid 10 locatable on the ground 12 as illustrated in FIG. 1. The aid 10 includes two spaced ground engaging feet 14 which are generally rectangular in plan view. The feet 14 are shown diagrammatically in FIGS. 5 and 6. A generally semi-circular frame 16 extends in a vertical plane between the feet 14 and mounts a downwardly directed light unit 18 at its mid-point. A retractable handle 20 is provided above the light unit 18 to permit carrying of the aid 10.

The light unit 18 includes a downwardly directing LED light source 22. A tube 24 is provided beneath the light source 22 and a convex lens 26 is provided at the lower end of the tube 24. FIG. 4 illustrates how the light from the source 22 is directed by the lens 26 to provide a circle 28 of light on the ground of the same size as a standard golf hole, i.e. with a diameter of around 108 mm.

Figure 5:
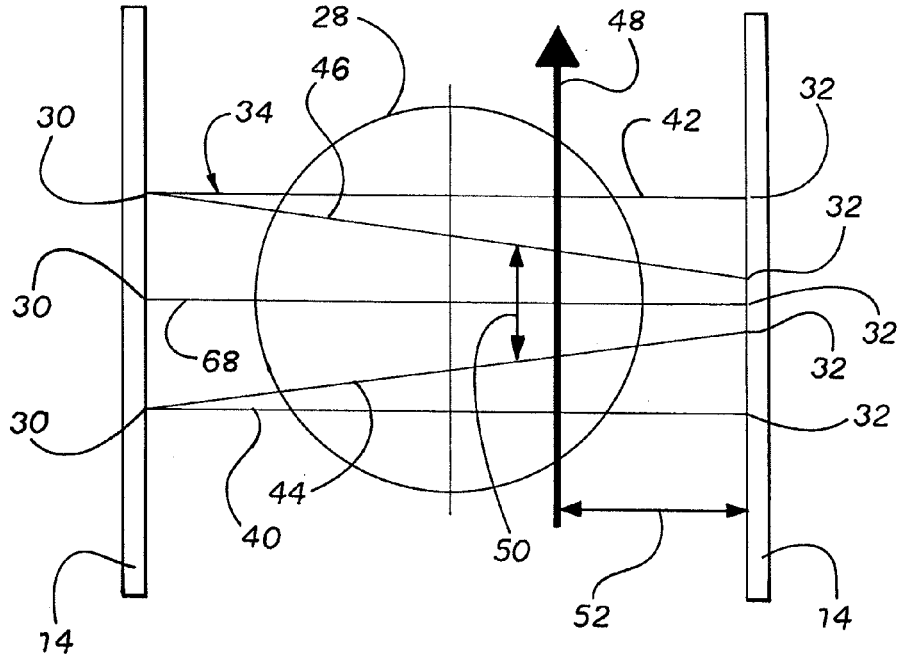
FIGS. 5 and 6 are schematic plan views illustrating operation of the aid of FIG. 1.

Five beam transmitters 30 are provided in the left hand foot 14 as shown in FIGS. 1 and 3. The transmitters 30 produce infra red beams, modulated at 38 kHz (nominal). Corresponding beam receivers 32 are provided in the right foot 14 as shown in FIGS. 1 and 3. The transmitters 30 produce five beams 34 as shown in FIG. 5 and described in further detail below. The aid 10 also comprises a control unit and loud speaker.

In use the aid 10 is located where required which may be indoors or outdoors, and the unit is particularly suited to indoor practice. The light source 22 is illuminated to produce the circle 28 on the ground beneath the aid 10. A golf ball can then be struck from any direction aiming to pass as near as possible beneath the centre of the circle 28. As the ball passes through or near the circle 28 the respective beams 34 are broken. The timing and duration of the break of the respective beams 34 is measured to determine the outcome of the shot as if the circle 28 had been a real golf hole.

The determination of this outcome will now be described. The transmitters 30 produce front and rear outer beams 40, 42. When a one of the beams 40, 42 is broken this commences a measurement sequence for the passage of the golf ball. If the beam 40 is first broken it will be determined as a forward shot, whilst if the beam 42 is first broken this will be considered a backward shot. Once the other of the beams 40, 42 is subsequently broken, the measurement sequence will have been completed.

Two detection beams 44, 46 are provided between the outer beams 40, 42, with the detection beams 44, 46 converging at an angle α towards the right hand foot 14 as shown in the drawings, but the detection beams 44, 46 do not cross. With a forward shot, following breaking of the beam 40 to initiate the measurement sequence, the detection beam 44 nearest the beam 44 will then be broken. The duration of the breaking of the beam 44 is measured in msec, and when this is divided into the ball diameter, conventionally 43 mm, this provides a velocity in mm/msec.

The time between breaking of the detection beam 44 and the detection beam 46 is also measured. This is then multiplied by the velocity to provide the distance travelled in the direction of the ball movement. The direction of movement is shown by the line 48, and the distance travelled between the beams 44, 46 is illustrated by the line 50. The gap is then divided by the tangent of the angle α to provide the lateral position of the gap along the beam system, from the right foot 14. This lateral position is shown by the line 52.

The ball then proceeds through the rear outer beam 42 to complete the sequence. All of the beams 40, 42, 44, 46 are located at a height above the ground so as to be substantially level with the centre of the ball. This sequence is obviously reversed for backward putts. If a velocity of greater than 1.14 mm/msec is detected, the putt is classed as over hit, i.e. the ball would jump over or around the hole without entering it.

Figure 6:
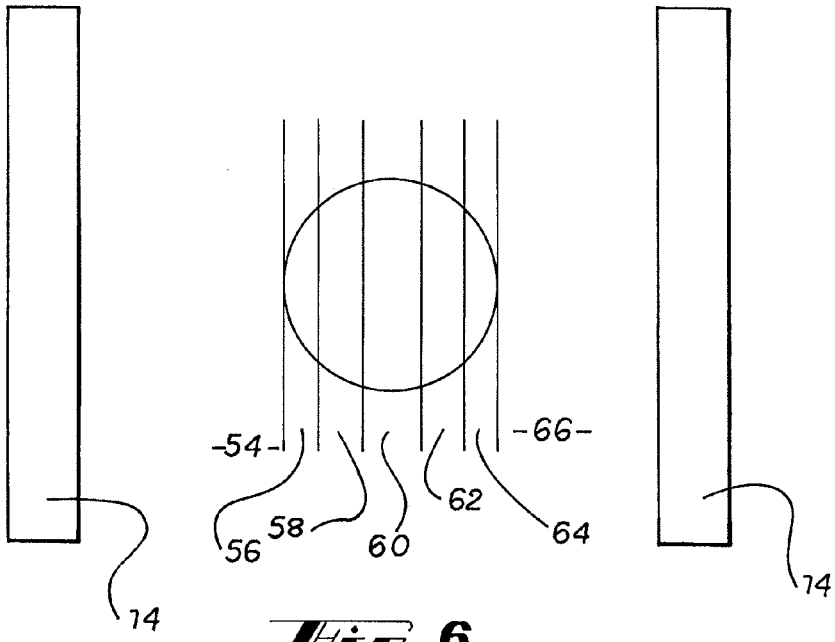

Once the lateral position of the line of the ball has been established, the result of the putt is calculated by comparison with preset values corresponding to five zones within the hole as shown by the circle 28, and two zones outside the hole. These zones are illustrated in FIG. 6 and from left to right are respectively: missed left 54; left lip 56; left of centre 58; centre of hole 60; right of centre 62; right lip 64; and missed right 66. If the ball passes through one of the five zones within the hole, and the velocity is not greater than 1.14 mm/msec, the ball is considered as entering the hole.

Once the position and speed of the ball has been determined, an audible message will be given through the loud speaker to indicate whether the shot has been successful or is a miss and where in or outside of the hole the ball passed. A central beam 68 is also provided which is only considered if the measurement sequence fails to complete because both of the outer beams 40, 42 have not been broken. The beam 68 if activated will detect if a ball remains in or adjacent the circle 28, and an appropriate audible signal will be provided to suggest that the ball should now be removed from this location.

There is thus described a putting practice aid which by virtue of a virtual golf hole provides a realistic target. The aid also provides a signal as to whether the ball would have landed in the hole, and where it would have entered the hole. This provides verbal feedback to the player, relating to the line and speed of each putt, to allow them to modify their action or technique as required.

As an audible signal is provided there is no requirement for a player to raise their head to see where the putt has gone. An indication of whether or not the ball was over hit and therefore would not have landed in the hole is provided, and again without the requirement for a player to look up to see where a ball has finally come to rest.

The aid is of relatively simple construction and can thus be robustly manufactured for long term reliable use. No calculations are required by a user, but an accurate indication of the outcome of shots is readily and rapidly provided.

Various modifications may be made without departing from the scope of the arrangement. For instance, a different arrangement of beams may be used, and the beams could be other than infra red, and could be light beams. A different light unit could be provided. A different arrangement of zones could be used.

Accordingly, while the invention has been described with reference to the structures and processes disclosed, it is not confined to the details set forth, but is intended to cover such modifications or changes as may fall within the scope of the following claims.

Applicants claim priority to UK Patent Application No. 0509050.1, filed in the United Kingdom on May 4, 2005.

What is claimed is:

1. A putting practice aid comprising a light source to project a visible image of a virtual golf hole as a putting target and a detector to determine the presence of a golf ball with respect to the virtual golf hole.

2. The putting practice aid of claim 1 further comprising a speaker receiving instructions from the detector to provide an audible signal as to whether a detected golf ball represents a successful putt to the virtual golf hole.

3. The putting practice aid of claim 2 wherein the audible signal includes verbal feedback indicating to a player where in or outside of the virtual hole the ball has passed.

4. The puffing practice aid of claim 3 wherein the detector includes a beam transmitter and a beam receiver, and wherein the detector determines the presence of a golf ball as it breaks a beam produced by the transmitter and received by the receiver.

5. The pulling practice aid of claim 4 wherein the detector includes a plurality of infrared beam transmitters and a plurality of infrared beam receivers, and wherein the detector determines the speed and direction of a golf ball as it breaks a plurality of beams between the transmitters and receivers.

6. The pulling practice aid of claim 4 wherein the detector includes a plurality of light beam transmitters and a plurality of light beam receivers, and wherein the detector determines the speed and direction of a golf ball as it breaks a plurality of beams between the transmitters and receivers.

7. The putting practice aid of claim 1 wherein the detector includes a beam transmitter and a beam receiver, and wherein the detector determines the presence of a golf bail as it breaks a beam produced by the transmitter and received by the receiver.

8. The putting practice aid of claim 7 wherein the detector includes a plurality of infrared beam transmitters and a plurality of infrared beam receivers, and wherein the detector determines the speed and direction of a golf ball as it breaks a plurality of beams between the transmitters and receivers.

9. The putting practice aid of claim 7 wherein the detector includes a plurality of light beam transmitters and a plurality of light beam receivers, and wherein the detector determines the speed and direction of a golf bail as it breaks a plurality of beams between the transmitters and receivers.

10. A putting practice aid comprising an illumination source to provide a visible image of a virtual golf hole and beams detection means for detecting the presence of a golf ball with respect to the virtual golf hole.

11. The putting practice aid of claim 10 wherein said beam detection means is an infrared beams detection means.

12. The putting practice aid of claim 11 further comprising audible feedback means for communicating putt results information based on the determination of the infrared beams detection means.

13. The putting practice aid of claim 10 wherein said beam detection means is a light beams detection means.

14. The putting practice aid of claim 13 further comprising audible feedback means for communicating putt results information based on the determination of the light beams detection means.

15. A putting practice aid comprising:

(a) an illumination source to project a visible image of a virtual golf hole as a putting target; and (b) a detector comprising a plurality of beam transmitters projecting a plurality of beams to a plurality of beam receivers, wherein the detector detects the presence of a golf ball with respect to the virtual golf hole as the golf ball breaks at least one of the plurality of beams projected between the beam transmitters and beam receivers.

16. The putting practice aid of claim 15, wherein the detector further detects whether the golf ball crosses the virtual golf hole.

17. The putting practice aid of claim 16, wherein the detector further determines the speed, position, and direction of the golf ball crossing the virtual golf hole.

18. The putting practice aid of claim 17, wherein each of the plurality of beam transmitters transmits one of the plurality of beams to a respective one of the plurality of beam receivers.

19. The putting practice aid of claim 18, wherein the beam transmitters and the beam receivers are located on opposite sides of the virtual golf hole and the detector detects the golf ball as the golf ball passes between the beam transmitters and the beam receivers.

20. The pulling practice aid of claim 17, wherein the plurality of beams are located at a height so as to be substantially level with the center of the golf ball.

21. The putting practice aid of claim 20, wherein the audible signal includes verbal feedback indicating to a player where in or outside of the virtual hole the ball has passed.

22. The putting practice aid of claim 17, further comprising a speaker receiving instructions from the detector to provide an audible signal as to whether a detected golf ball represents a successful pull to the virtual golf hole.

* * * * *

UNITED STATES PATENT AND TRADEMARK OFFICE

CERTIFICATE OF CORRECTION

PATENT NO. : 7,297,069 B2
APPLICATION NO. : 11/220829
DATED : November 20, 2007
INVENTOR(S) : Michael Kevin Donovan and Michael John Boyle It is certified that error appears in the above-identified patent and that said Letters Patent is hereby corrected as shown below:

The claims should read as follows:

Col. 4 line 29 “puffing” should read --putting--

Col. 4 line 34 “pulling” should read --putting--

Col. 4 line 40 “pulling” should read --putting--

Col. 4 line 47 “bail” should read --ball--

Col. 6 line 10 “pulling” should read --putting--

Col. 6 line 21 “pull” should read --putt--

Signed and Sealed this

Tenth Day of June, 2008

JON W. DUDAS
*Director of the United States Patent and Trademark Office*